US009751536B2

(12) United States Patent
Galvan et al.

(10) Patent No.: US 9,751,536 B2
(45) Date of Patent: Sep. 5, 2017

(54) RAILROAD HOPPER CAR DOOR OPERATING MECHANISM

(71) Applicants: Guadalupe L. Galvan, DeKalb, IL (US); Christopher C. Gaydos, Hampshire, IL (US); Steve R. White, Maple Park, IL (US); Eric F. Wenzel, Lindenhurst, IL (US)

(72) Inventors: Guadalupe L. Galvan, DeKalb, IL (US); Christopher C. Gaydos, Hampshire, IL (US); Steve R. White, Maple Park, IL (US); Eric F. Wenzel, Lindenhurst, IL (US)

(73) Assignees: MINER ENETERPRISES, INC., Geneva, IL (US); POWERBRACE CORPORATION, Kenosha, WI (US)

( * ) Notice: Subject to any disclaimer, the term of this patent is extended or adjusted under 35 U.S.C. 154(b) by 157 days.

(21) Appl. No.: 14/691,924

(22) Filed: Apr. 21, 2015

(65) Prior Publication Data

US 2016/0311445 A1 Oct. 27, 2016

(51) Int. Cl.

| | |
|---|---|
| ***B61D 7/26*** | (2006.01) |
| ***B61D 7/02*** | (2006.01) |
| ***B61D 7/18*** | (2006.01) |

(52) U.S. Cl.

CPC ..... *B61D 7/26* (2013.01); *B61D 7/02* (2013.01); *B61D 7/18* (2013.01)

(58) Field of Classification Search

CPC ... B61D 7/00; B61D 7/02; B61D 7/04; B61D 7/14; B61D 7/16; B61D 7/18; B61D 7/20; B61D 7/24; B61D 7/26; B61D 7/28; B61D 7/30; B61D 7/32

See application file for complete search history.

(56) References Cited

U.S. PATENT DOCUMENTS

| | | | |
|---|---|---|---|
| 1,062,384 | A | 5/1913 | Campbell |
| 2,493,468 | A | 1/1950 | Swann |
| 3,104,623 | A | 9/1963 | Dorey |
| 3,256,836 | A | 6/1966 | Floehr |

(Continued)

*Primary Examiner* — R. J. McCarry, Jr.

(74) *Attorney, Agent, or Firm* — Law Office of John W. Harbst

(57) ABSTRACT

A mechanism for operating one or more hinged doors on a hopper car including an elongated operating shaft having a fixed axis of rotation and a linkage system for operably connecting the operating shaft to the hinged doors on the railroad hopper car. The linkage system includes an actuating link operably connected to and rotatable with the operating shaft and a connecting link for operably connecting the actuating link to each door. The linkage system links includes a primary lock for holding each door in the closed position. A selectively operated secondary lock is rotatable about a fixed axis disposed above the fixed axis of the operating shaft assembly. The secondary lock rotates between a first condition, wherein a stop engages with at least one link of the linkage assembly, and a second condition, wherein each door is permitted to move to the open position. A release mechanism is provided for releasing the primary lock by moving at least one of the links of the linkage system relative to the other thereby allowing the door to be forcibly moved toward their open position under the influence of the columnar load being placed thereon by the lading in the hopper.

35 Claims, 11 Drawing Sheets

(56) References Cited

U.S. PATENT DOCUMENTS

| | | | | |
|---|---|---|---|---|
| 3,434,433 | A | 3/1969 | Floehr | |
| 3,440,761 | A | 4/1969 | Floehr | |
| 3,469,539 | A | 9/1969 | Damy | |
| 3,611,947 | A | 10/1971 | Nagy | |
| 3,654,873 | A | 4/1972 | Floehr | |
| 4,163,424 | A | 8/1979 | Lindauer | |
| 4,184,432 | A | 1/1980 | Adler | |
| 4,601,244 | A | 7/1986 | Fischer | |
| 4,741,274 | A | 5/1988 | Ferris et al. | |
| 5,063,858 | A | 11/1991 | Dugge | |
| 5,086,709 | A | 2/1992 | Fischer et al. | |
| 5,601,032 | A | 2/1997 | Kosch | |
| 6,019,049 | A | 2/2000 | Gaydos et al. | |
| 6,227,124 | B1 | 5/2001 | Gaydos et al. | |
| 6,279,487 | B1 | 8/2001 | Gaydos et al. | |
| 6,604,469 | B1 | 8/2003 | Galvan et al. | |
| 7,493,865 | B2 | 2/2009 | Galvan | |
| 7,654,205 | B2 * | 2/2010 | Galvan ..... | B61D 7/18 105/280 |

* cited by examiner

FIG. 8
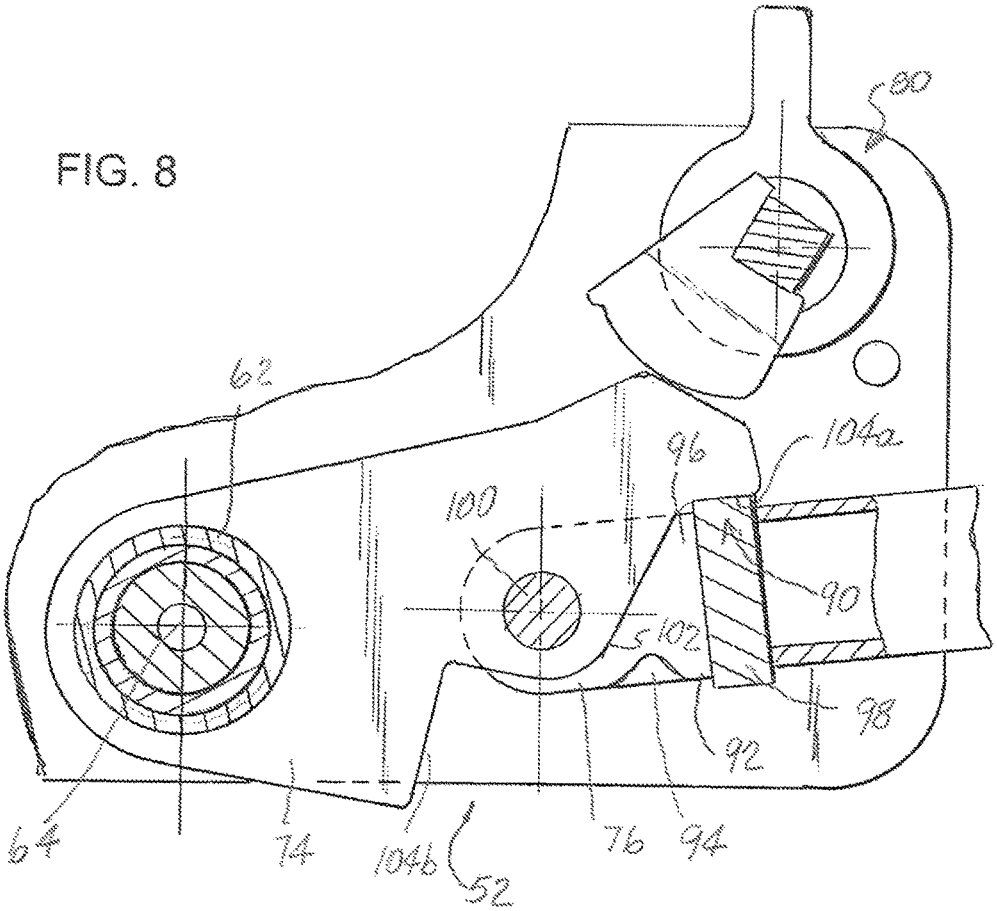
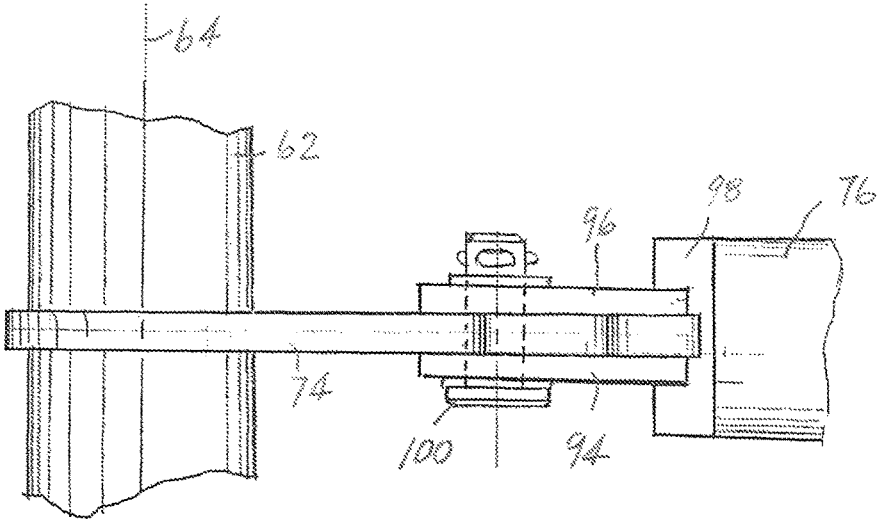
FIG. 9

RAILROAD HOPPER CAR DOOR OPERATING MECHANISM

FIELD OF THE INVENTION DISCLOSURE

The present invention generally relates to railroad hopper cars, and more specifically, to a mechanism for selectively operating one or more hinged doors on a railroad hopper car.

BACKGROUND OF THE INVENTION DISCLOSURE

A common type of railroad freight car in use today is an open-top hopper car wherein lading carried by the hopper car is discharged through openings provided on an underside or bottom of the car. Such cars are used to transport numerous types of lading including aggregate, iron ore and other types of lading. Such cars offer an advantageously economical method of transporting large amounts of lading between distant locations.

Such railroad cars generally include a walled enclosure or hopper carried on an underframe of the railcar. On some railroad hopper cars, the underframe includes a longitudinally elongated centersill or support which defines a longitudinal axis for the railcar. Toward opposed ends thereof, the centersill is carried by the usual wheeled trucks which ride on tracks or rails. Although the design of the bottom of the railcar varies considerably, the hopper is typically provided with a plurality of generally funnel-shaped chutes which extend either parallel to the longitudinal axis of the railcar (longitudinal openings) or are disposed in pairs on opposite lateral sides of the longitudinal axis of the railcar (transverse openings). The generally funnel-shaped chute terminates in a discharge opening through which lading is gravitationally discharged from the railcar. Each type of hopper serves a particular need in the railroad industry.

To control the discharge of lading from the hopper, a door is provided in registry with either both or each discharge openings on the railcar. Typically, the discharge door is hinged toward an upper end thereof to the railcar such that, when released, the door gravitationally swings toward an open position assisted by columnar load of the lading gravitationally pushing down on and moving through each discharge opening.

Different types of door operating mechanisms are known in the prior art. It is important to note, however, such door operating mechanism are specifically designed to the particular operation with which they will find utility. For example, a mechanism used to operate longitudinally mounted doors cannot, without significant redesign, be used to operate transversely arranged doors and vice versa. Moreover, and primarily because of the disposition of the door relative to the longitudinal axis of the railcar, mechanisms used to operate longitudinally mounted doors usually require a powered operated driver to move the doors between closed and open positions. As will be appreciated, requiring a powered operated driver to operate such mechanism increases the overall cost of the railcar. Of course, increasing any manufacturing costs is adverse to railcar manufacturers. Thus, those mechanisms used to operate longitudinally mounted doors do not and are not useful with those hopper cars having transversely mounted doors for selectively controlling the discharge of lading from the hopper.

Designing a mechanism for operating one or more transversely mounted doors on a railroad hopper car also has design challenges. In hopper cars of the identified type having the doors extending transversely of the hopper car, a generally accepted method of maintaining the doors in the closed position involves the employment of independently functioning latching mechanism on opposed sides of the hopper car. Previously known latching mechanisms include a pivotable hook that is actually a double hook in that it has a small recess which engages with a device to hold the door in a "catch" position and one larger recess to hold the door in a fully closed position. Two operators or workmen generally work together on opposite sides of the railcar and swing the open laterally adjacent doors from the fully open position to the "catch" position by pushing with one foot on the respective doors. In the "catch" position, the doors remain open a few inches at their lower end. Each workman next places a long pry bar , usually about 5 foot long and about 1.5 inches in diameter, to lever the door to a fully closed position whereupon the larger recess on each hook drops in to its working position. In operation, this mechanism has been known to fail to maintain the doors in their closed position. Moreover, and as will be appreciated, unless the locks are positively operated in unison relative to each other, additional problems can and do arise, That is, there is significant columnar load placed on beach door by the lading in the hopper of the railcar. Although the transversely disposed doors are typically joined by an elongated connector or spreader bar, opening one lock without opening the other lock can cause the door to twist about its upper pivot thus possibly resulting in door distortion problems.

Both the length and width of each discharge opening defined toward the lower end of each hopper chute must be sufficiently sized to substantially prevent lading from bridging over the discharge outlet so as to facilitate the discharge of lading from the hopper car. Accordingly, the door arranged in operable combination with such discharge opening must be sized to cover the entire opening when the door is in the closed position. As such, the weight of the door is substantial, thus, adding to the effort required of the operator to close the door from the open position. Considering there are up to four sets of transversely mounted doors on each hopper rail car which are all required to be manually closed after the lading is discharged therefrom, the continuing manual effort required to close the doors is both tedious and tiring.

To unlock this type of prior art door lock, a workman on each side of the railcar drives the respective hook upwards to release the door. Sometimes the hook stays up momentarily, permitting the door to move to the fully open position. At other times, the hook may drop earlier in time to hold the door in the "catch" position, in which case, the workmen is required to hammer the hook upward to release the door to a fully open position. The hook is operated primarily by gravity, making the operation thereof somewhat dependent upon the particular orientation of the hopper car and the freedom with which the hook pivots about its pivot pin.

As mentioned, the bottom of the railcar is typically designed to have several funnel-shaped chutes disposed between opposed ends the railcar. Accordingly, the spacings between longitudinally adjacent chutes wherein the operating mechanism for such doors is to be located is extremely limited. As will be appreciated by those skilled in the art, the limited space constraints inherent with hopper cars having transversely mounted doors operable in pairs causes significant design problems.

Thus, there is a need and continuing desire for a mechanism for operating in unison a pair of transversely mounted doors on a railroad hopper car having a centersill.

SUMMARY

In view of the above, and in accordance with one aspect of this invention disclosure, there is provided a mechanism for operating a pair of hinged doors on a railroad hopper car between closed and open positions. The railroad hopper car has a centersill defining a longitudinal axis and a hopper operably supported on the centersill. The hinged doors are arranged in operable combination with adjoining hopper openings defined by the hopper and disposed to opposed lateral sides of the longitudinal axis of the hopper car.

In this embodiment, the mechanism for operating the pair of hinged doors includes an elongated operating shaft rotatable about a fixed axis and adapted to extend transverse to the longitudinal axis of the hopper car. In this embodiment, the operating shaft is configured to extend across the railcar such that opposed ends of the shaft are each accessible from a side of the hopper car to effect selective operation of the pair of doors. A linkage system operably connects the operating shaft to the hinged doors on the railroad hopper car so as to simultaneously move the doors into their closed positions in response to rotation of the operating shaft. The linkage system includes an actuating link operably connected to and rotatable with the operating shaft and a connecting link for operably connecting the actuating link to the doors. The linkage system links are arranged in an overcenter relationship relative to each other when the doors are in the closed position whereby locking the doors closed. A selectively operated stop is rotatable about a fixed axis disposed above the fixed axis of the operating shaft assembly. The stop is rotatable between a first condition, wherein the stop engages with at least one link of the linkage assembly whereby maintaining the linkage system links in an overcenter relationship relative to each other, and a second condition, wherein the doors are permitted to move to the open position.

Preferably, the mechanism for operating the pair of hinged doors further includes a transversely elongated connector for joining the doors to each other. In one form, the actuating link of the linkage system is one of duplicate actuating links operably connected to and rotatable with the operating shaft. Similarly, in a preferred embodiment, the connecting link of the linkage system is one of duplicate connecting links for operably connecting a respective actuating link to the doors.

In one form, the linkage system includes a stop for limiting movements of the doorstoward their open position. Moreover, the linkage system preferably includes a stop for limiting movements of said doors toward their closed position.

Preferably, the selectively operated stop forming part of the mechanism for operating the pair of hinged doors on the railroad hopper car has limited rotation about its fixed axis. In a preferred embodiment, and to facilitate assembly of the mechanism for operating the pair of hinged doors on the railcar, the operating shaft, the linkage system and the selectively operated stop are all mounted on a frame mountable to the railroad hopper car.

According to another aspect, there is provided a mechanism for operating a pair of hinged doors on a railroad hopper car. The railroad hopper car has a centersill defining a longitudinal axis and a pair of drop-bottom outlets for discharging lading from a hopper operably carried on the centersill. The outlets are disposed on opposed lateral sides of the longitudinal axis of the car, with each outlet having one of the hinged doors arranged in operable combination therewith for movement between a closed position and an open position. A length and width of each outlet is sufficient to inhibit lading from bridging over the outlet thereby facilitating discharge of lading from the hopper.

According to this aspect of the invention disclosure, the door operating mechanism includes a frame mountable to the railroad hopper car and an elongated operating shaft mounted on the frame for rotation about a fixed axis and adapted to extend transverse to the longitudinal axis of the hopper car. The operating shaft is configured to extend across the railroad hopper car such that opposed ends of the shaft are each accessible from a side of the hopper car. A linkage system is provided for operably connecting the operating shaft to the hinged doors on the railroad hopper car to simultaneously move the doors into their closed positions in response to rotation of the operating shaft. The linkage system includes an actuating link, operably connected to and rotatable with the operating shaft, and a connecting link for operably connecting the actuating link to the doors. The linkage system links are arranged in an overcenter relationship relative to each other when the doors are in the closed position whereby locking the doors closed.

A door release mechanism including a release lever is mounted on the frame for rotation about a fixed axis. The release lever is operably associated with the linkage system such that rotation of the release lever moves at least one of the links from being overcenter relative to the other link of the linkage system thereby allowing the doors to be forcibly moved toward the open position under the influence of the columnar load being placed on the doors by lading in the hopper.

In one form, the mechanism for operating the pair of hinged doors on the railroad hopper car further includes a transversely elongated connector for joining the doors to each other. Preferably, the actuating link of the linkage system is one of duplicate actuating links operably connected to and rotatable with the operating shaft, and wherein the connecting link of the linkage system is one of duplicate connecting links for operably connecting a respective actuating link to the doors. In a preferred embodiment, the linkage system includes a stop for limiting movements of the doors toward their open position. In a preferred embodiment, the linkage system includes a stop for limiting movements of the doors toward their closed position.

In a preferred embodiment, the mechanism for operating the pair of hinged doors on the railroad hopper further includes a selectively operated stop rotatable about a fixed axis disposed above the fixed axis of the operating shaft assembly. The stop is preferably rotatable between a first condition, wherein the stop engages with at least one link of the linkage assembly whereby maintaining the links of the linkage system in an overcenter relationship relative to each other, and a second condition, wherein the doors are permitted to move to the open position. In one form, the selectively operated stop has limited rotation about its fixed axis.

In another family of embodiments, there is provided a mechanism for operating a pair of hinged doors on a railroad hopper car between closed and open positions. The railroad hopper car has a centersill defining a longitudinal axis. A hopper is operably supported on the centersill with the hinged doors being arranged in operable combination with adjoining hopper openings defined by the hopper and disposed to opposed sides of the longitudinal axis of the hopper car. In this form, the door operating mechanism includes an elongated operating shaft rotatable about a fixed axis and adapted to extend transverse to the longitudinal axis of the hopper car. The operating shaft is configured to extend across the railcar such that opposed ends of the shaft are each accessible from a side of the hopper car to effect selective operation of the doors.

According to this aspect, the mechanism for operating hinged doors on the railroad hopper car further includes a linkage system for operably connecting the operating shaft to the hinged doors on the railroad hopper car to simultaneously move the doors into their closed positions in response to rotation of the operating shaft in first direction. The linkage system including a crank arm operably connected to and rotatable with the operating shaft and a link for operably connecting the crank arm to the doors. The crank arm and the connecting link of the linkage system are arranged in an overcenter relationship relative to each other when the doors are in the closed position so as to provide a releasable lock against the doors moving toward the open position In this embodiment, a selectively operated stop is rotatable about a fixed axis disposed above the fixed axis of the operating shaft assembly. The stop is rotatable between a first condition, wherein said stop engages with at least one of the crank arm and the link of the linkage assembly whereby maintaining the crank arm and the connecting link of the linkage assembly in an overcenter relationship relative to each other, and a second condition, wherein the doors are permitted to move to the open position. A door release mechanism rotatable about a fixed axis is provided for releasing the lock by moving at least one of the crank arm and the connecting link from being overcenter relative to the other one of the crank arm and the connecting link thereby allowing the doors to be forcibly moved toward their open position under the influence of the columnar load being placed on the doors by the lading in the hopper.

In a preferred form, the mechanism for operating the pair of hinged doors on the railroad hopper car further includes a transversely elongated connector for joining the doors to each other. Preferably, the crank arm of the linkage system is one of duplicate crank arms operably connected to and rotatable with the operating shaft, and wherein the connecting link of the linkage system is one of duplicate connecting links for operably connecting the respective actuating link to the doors.

Preferably, the linkage system includes a stop for limiting movements of the doors toward their open position. In a preferred embodiment, the linkage system further includes a stop for limiting movements of the doors toward their closed position According to this embodiment of the invention disclosure, the operating shaft, the linkage system and the selectively operated stop are all mounted on a frame mountable to the railroad hopper car. Preferably, the selectively operated stop has limited rotation about its fixed axis.

According to another aspect of this invention disclosure, there is provided a mechanism for operating a pair of hinged doors on a railroad hopper car between closed and open positions, with the railroad hopper car having a centersill defining a longitudinal axis. A hopper is operably supported on the centersill, with the hinged doors being arranged in operable combination with adjoining hopper openings defined by the hopper and disposed to opposed sides of the longitudinal axis of the hopper car. The door operating mechanism includes a linkage system including an actuating link, having a first fixed fulcrum, and a connecting link for operably connecting the actuating link to the hinged doors and for simultaneously pushing the doors into their closed positions in response to rotation of the actuating link about the first fixed fulcrum. The links of the linkage system are operably connected in an overcenter relationship relative to each other when the doors are in the closed position whereby locking the doors closed. A selectively operated stop is rotatable about a second fixed fulcrum disposed above the first fixed fulcrum of the operating shaft assembly. The stop is rotatable between a first condition, wherein the stop engages with at least one link of the linkage assembly whereby maintaining the links of the linkage system in an overcenter relationship relative to each other, and a second condition, wherein the doors are permitted to move to the open position.

In this embodiment, the mechanism for operating the pair of hinged doors further includes a transversely elongated connector for joining the doors to each other. Preferably, the the actuating link of the linkage system is one of duplicate actuating links rotatable about the first fixed fulcrum. Moreover, in this embodiment, the connecting link of the linkage system is one of duplicate connecting links for operably connecting the respective actuating link to the doors.

Preferably, the linkage system includes a stop for limiting movements of the doors toward the open position. Moreover, the linkage system preferably includes a stop for limiting movements of the doors toward the closed position.

In this embodiment, the linkage system and the selectively operated stop are mounted on a frame mountable to the railroad hopper car. Preferably, the selectively operated stop has limited rotation about its fixed axis. A door release mechanism is preferably arranged in operable combination with the mechanism for selectively operating the hinged doors for releasing the lock by moving at least one of the actuating link and the connecting link of the linkage system from the overcenter relationship relative to the other one of the actuating link and the connecting link thereby allowing the doors to be forcibly moved toward the open position under the influence of the columnar load being placed on the doors by the lading in the hopper.

According to yet another aspect of this invention disclosure, there is provided a mechanism for operating a hinged door on a railroad hopper car between closed and open positions. The railroad hopper car has a hopper and the hinged door is arranged in operable combination with an opening defined by the hopper. According to this aspect of the invention disclosure, the door operating mechanism includes an elongated operating shaft rotatable about a fixed axis and a a linkage system for operably connecting the operating shaft to the hinged door on the railroad hopper car to move the door into the closed position in response to rotation of the operating shaft. The linkage system includes an actuating link operably connected to and rotatable with the operating shaft and a connecting link for operably connecting the actuating link to the door. The links of the linkage system are arranged in an overcenter relationship relative to each other when the door is in the closed position whereby locking the door closed. A selectively operated stop is rotatable about a fixed axis disposed above the fixed axis of the operating shaft assembly. The stop is rotatable between a first condition, wherein the stop engages with at least one link of the linkage assembly to prevent rotation of the operating shaft while maintaining the links of the linkage system in an overcenter relationship relative to each other, and a second condition. In the second condition, the stop permits the door to move to the open position.

Preferably, the linkage system includes a stop for limiting movements of the hinged door toward the open position. In one form, the linkage system includes a stop for limiting movements of said hinged door toward the closed position.

According to this aspect of the invention disclosure, the operating shaft, the linkage system and the selectively operated stop are all mounted on a frame mountable to the railroad hopper car. Moreover, in this embodiment, the mechanism for operating the hinged door further includes a door release mechanism including a release lever mounted on the frame and operably associated with the linkage system such that rotation of the release lever moves at least one of the links from being overcenter relative to the other link of said linkage system thereby allowing the door to be forcibly moved toward the open position under the influence of the columnar load being placed on said door by lading in said hopper.

DESCRIPTION OF THE DRAWINGS

FIGS. 8, 9 and 10 are enlarged views, partly in section, of a portion of door operating apparatus shown in FIGS. 6 and 7;

DETAILED DESCRIPTION

Figure 1:
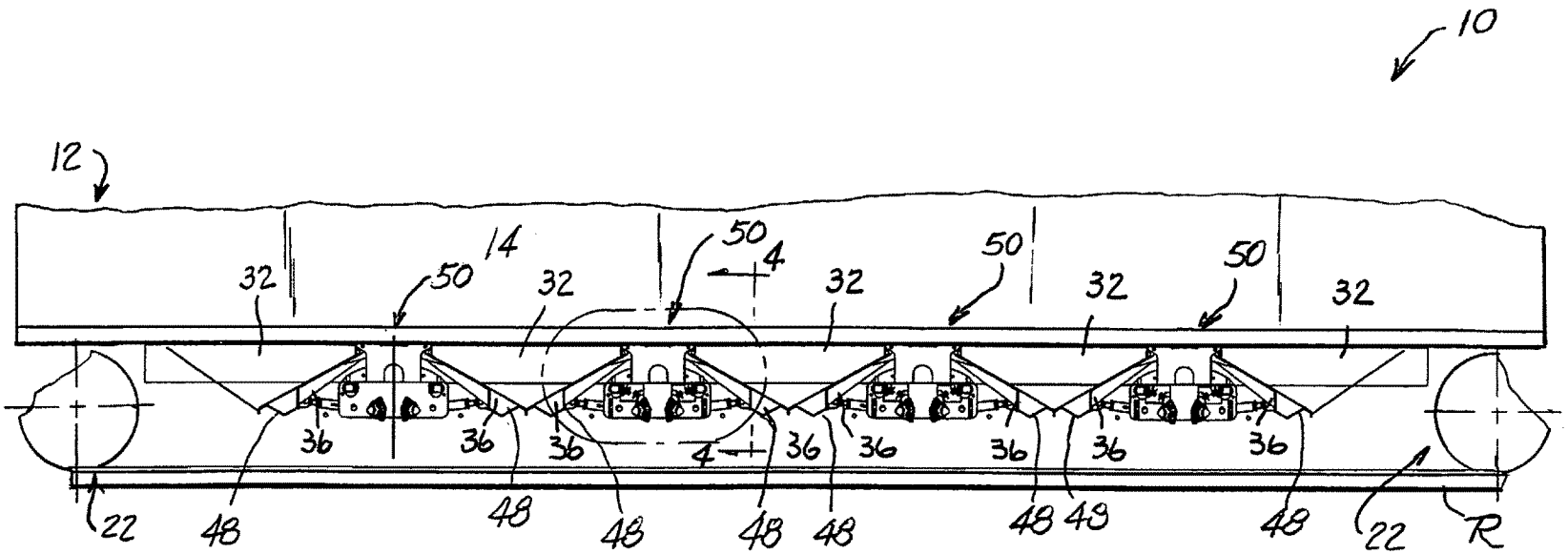
FIG. 1 is a side elevational view of a hopper car embodying teachings and principals of this invention disclosure.

While this invention disclosure is susceptible of embodiment in multiple forms, there is shown in the drawings and will hereinafter be described a preferred embodiment, with the understanding the present disclosure is to be considered as setting forth an exemplification of the disclosure which is not intended to limit the disclosure to the specific embodiment illustrated and described.

Referring now to the drawings, wherein like reference numerals indicate like parts throughout the several views, in FIG. 1 there is shown a railroad hopper car, generally indicated by reference numeral 10, which moves over tracks or rails R between locations. Although railroad hopper cars have a variety of different configurations, they generally have a walled enclosure or hopper 12 for storing and transporting lading, i.e, iron ore, rocks, stone, an the like therein. In the embodiment shown in FIG. 2, hopper 12 has pair of generally parallel sides 14 and 16 which are joined by a pair of opposed ends 17, 17'. In many configurations, the hopper 12 defines an open-top but the same can be closed if so desired without detracting or departing from the broad spirit and novel scope of this invention disclosure.

As shown in FIG. 1, the hopper 12 is supported and carried by an underframe or centersill 18 extending lengthwise of and defining a longitudinal axis 20 (FIG. 2) for the car 10. The centersill 18 is supported in a conventional manner toward opposite ends by conventional wheeled trucks, generally identified in FIG. 1 by reference numeral 22. As known, each wheeled truck 22 includes at least one pair of laterally spaced wheels which turn about an axis extending generally normal to the longitudinal axis 20 of car 10 (FIG. 2) and which ride on the rails R.

A bottom of the hopper 12 can also take a variety of different configurations. Suffice it to say, in the exemplary embodiment, the bottom of the hopper car 10 is provided with a plurality of longitudinally spaced discharge chutes 32. As shown by way of example in FIG. 2, each discharge chute 32 defines a pair of drop-bottom outlets or discharge openings 34, 34' preferably disposed in transversely aligned relation relative to each other and disposed to opposed lateral sides of the longitudinal axis 20 of car 10 for discharging lading from the hopper 12. The discharge openings 34, 34' are interposed between the centersill 18 and the respective side 14, 16 of the hopper 12 and through which lading is gravitationally discharged from the hopper 12. In the illustrated embodiment, a pair of doors 36, 36' are arranged in registry with the discharge openings 34, 34', respectively, for selectively controlling the discharge of lading from hopper 12. It should be appreciated, however, in a railcar utilizing side sills, a transversely elongated single hinged door can be arranged in operable combination and registry with the discharge opening defined by the hopper 12 for selectively controlling the discharge of lading from railcar 10.

Figure 3:
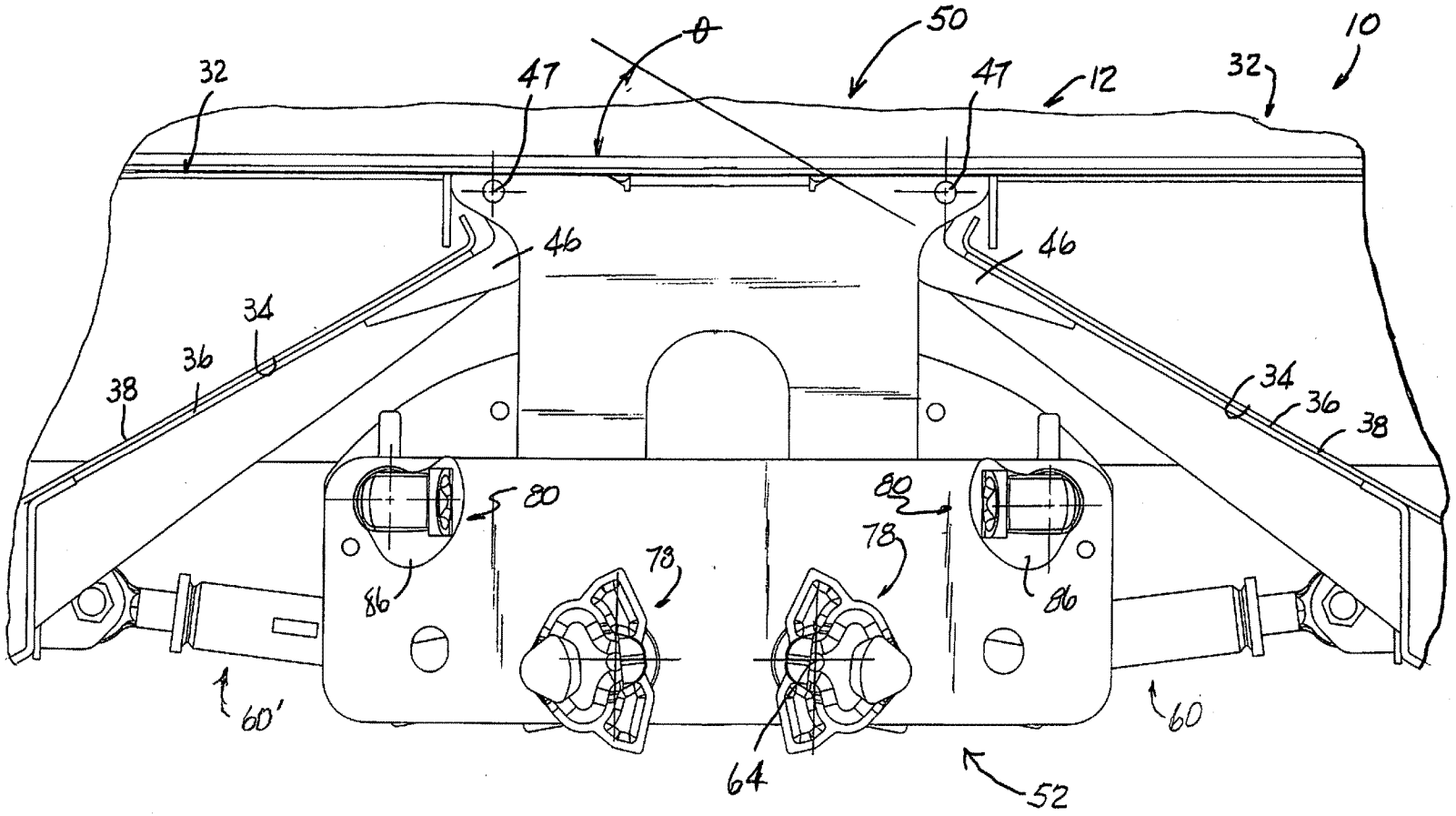
FIG. 3 is an enlarged side elevational view of the area encircled in phantom lines in FIG. 1.

In the illustrated embodiment, each outlet or discharge opening 34, 34' has a length and width sufficiently sized to inhibit lading from bridging over the outlet thereby facilitating the discharge of lading from the hopper 12. As shown in FIG. 3, each discharge chute 32 is defined, in part, by a floor 38 and angled sidewalls which depend from the hopper 12. The lower edge portions of the floor 38 and sidewalls 40 and 42 define the respective discharge opening 34, 34' of each discharge chute 32. In the illustrated embodiment, the floor 38 of each discharge opening 34, 34' is preferably disposed at an angle 0 relative to a horizontal plane. To enhance the throat opening of each discharge opening, the floor 38 is preferably disposed at an acute angle ranging between about 20 degrees and 25 degrees relative to a horizontal plane. In a most preferred embodiment, the floor 38 of each discharge opening is disposed at an angle ranging of about 22 degrees relative to a horizontal plane.

Figure 2:
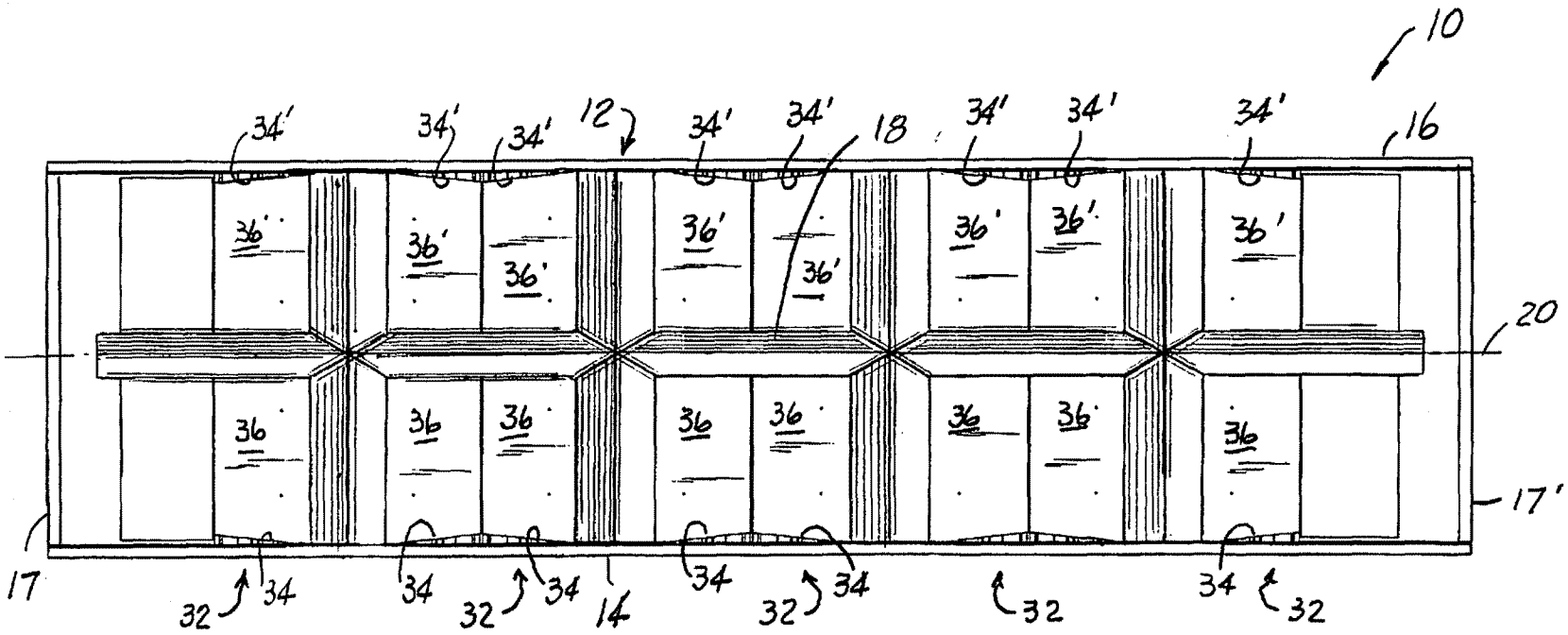
FIG. 2 is a top plan view of the hopper car illustrated in FIG. 1.

In the embodiment shown by way of example in FIG. 3, each door 36, 36' is hinged toward an upper end thereof by conventional hinge structure 46 allowing the doors to pivot about a generally horizontal axis 47 extending generally normal to the longitudinal axis 20 of car 10 (FIG. 2). When in a closed position, each door 36, 36' covers the respective discharge opening to inhibit lading from escaping from the hopper 12. As will be discussed in detail below, when released from the closed position relative to a respective discharge opening, each door 36, 36' moves or falls toward an open position under the influence of the columnar load of lading and gravity acting thereon. As shown in FIGS. 1 and 3, when in a closed position, each door 36, 36' assumes an inclined position relative to a horizontal plane.

Each pair of transversely aligned doors 36, 36' are preferably joined or operably connected to each other by a transversely elongated or extended crossbar or connector 48 to form an assembly of the two doors and causes them to swing together as a unit. As will be appreciated, the crossbar 46 can be of any suitable construction to effect simultaneous or conjoint operation of the doors 34, 34' operably associated with each discharge chute 32.

According to the present invention disclosure, and as shown in FIG. 1, two pairs or sets of doors associated with two longitudinally adjacent discharge chutes 32 on hopper 12 can be operated by an apparatus 50. In the embodiment illustrated in FIG. 3, apparatus 50 is shown disposed longitudinally between the two pairs or sets of doors associated with two longitudinally adjacent discharge chutes 32 on hopper 12. That is, in a preferred embodiment of the invention disclosure, each apparatus 50 on the hopper car 10 is capable of individually controlling the discharge of lading from the hopper car 10 as through selective operation of either or both of two pairs or sets of transversely arranged doors arranged in operable combination with the discharge openings defined by two longitudinally adjacent discharge chutes 32. The apparatus 50 of the present invention disclosure is preferably modular in design and is suspended from the centersill 18 between two transversely aligned discharge openings on hopper 12. In the illustrated embodiment, more than one apparatus 50 can be arranged on the hopper railcar 10.

Figure 4:
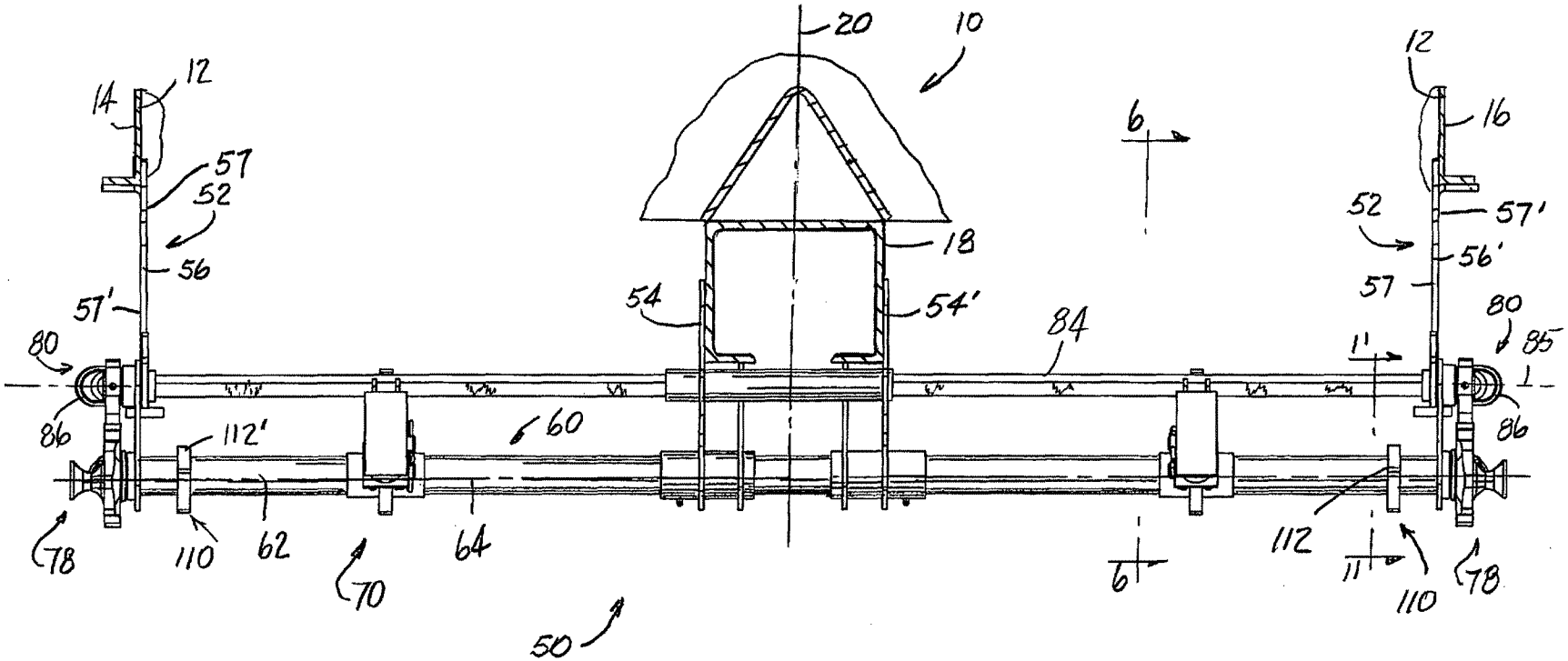
FIG. 4 is a fragmentary sectional view taken along line 4-4 of FIG. 1 but with some parts being removed for illustrative purposes.

Preferably, and to reduce costs, each apparatus 50 arranged on the hopper car 10 is substantially identical and, thus, only one apparatus 50 will be described in detail. In the embodiment illustrated by way of example in FIGS. 4 and 5, apparatus 50 includes a frame 52 preferably including a pair of generally vertical and generally parallel supports 54 and 54' which operably connect to and depend from the centersill 18 and a pair of generally vertical, generally parallel and transversely spaced end plates 56 and 56' which connect to and depend from the hopper 12. As shown, the end plates 56, 56' extend generally parallel to the supports 54, 54'. As shown in FIG. 4, each end plate 56, 56' has an inner face 57 disposed closest to the longitudinal axis 20 of the railcar 10 and an outer face 59.

Figure 5:
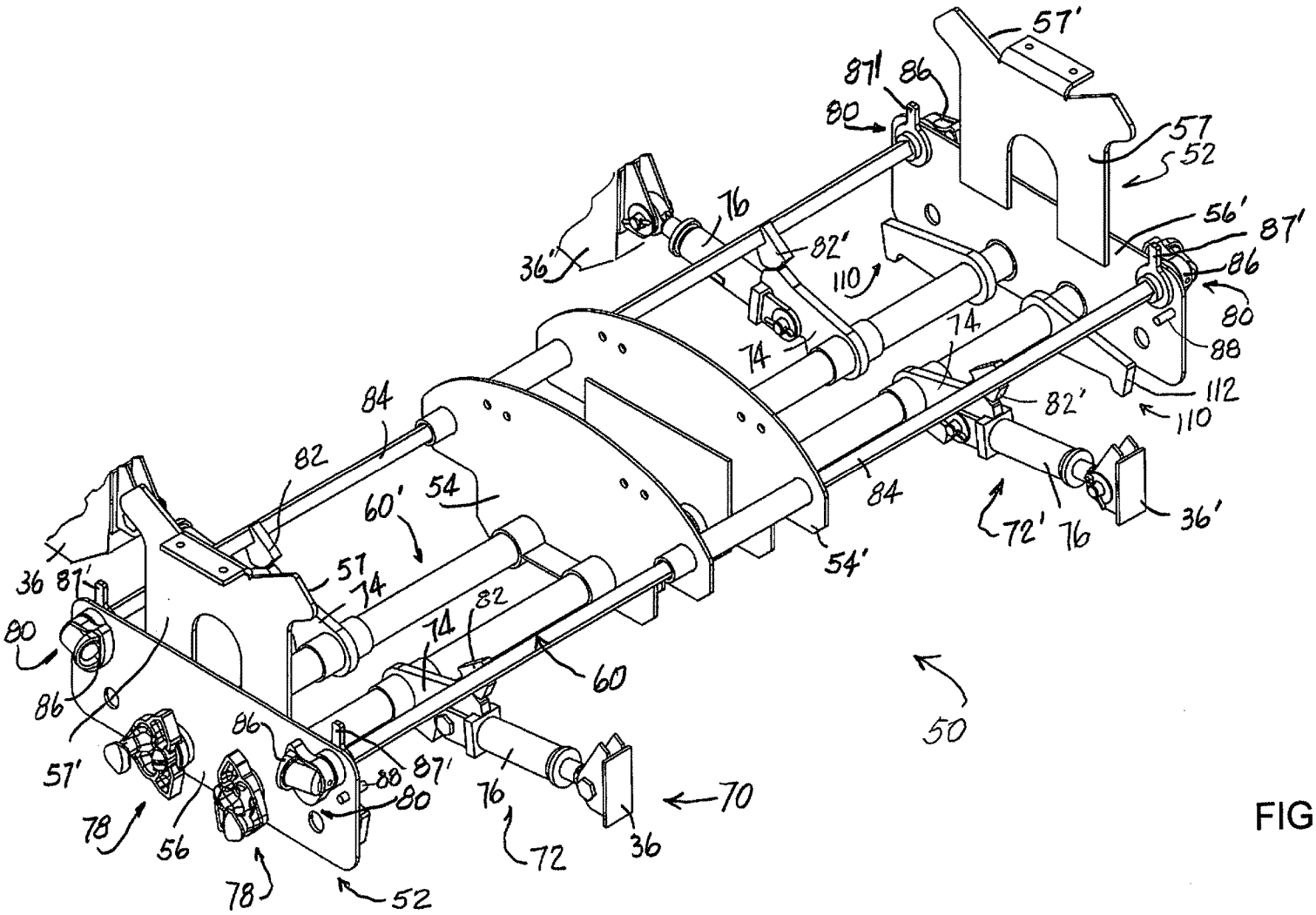
FIG. 5 is a top right perspective view of one form of an apparatus embodying teachings8and principals of this invention disclosure.

In the embodiment shown by way of example in FIG. 5, each apparatus 50 further includes two substantially identical mechanisms 60 and 60'. Mechanism 60 is carried on the frame 52 of apparatus 50 and is designed to selectively control and, in a preferred form, simultaneously operate one set or pair of doors on the hopper car 10. Mechanism 60' is also carried on the frame 52 of each apparatus 50 and is designed to selectively control and, in a preferred form, simultaneously operate the other set or pair of doors on the hopper car 10 longitudinally arranged adjacent to that set of doors operated by mechanism 60.

Preferably, and to reduce costs, each mechanism 60, 60' is substantially identical and, thus, only mechanism 60 will be described in detail. As shown in FIG. 4, each such mechanism includes an elongated operating shaft 62 which is rotatably supported and carried by the frame 52. Shaft 62 is rotatable about a fixed generally horizontal axis 64 and is adapted to extend transverse to the longitudinal axis 20 of hopper car 10. The operating shaft 62 is preferably of sufficient length to extend across the car 10 such that the ends of the operating shaft 62 are readily accessible to opposed sides 14, 16 of the railcar 10 to effect selective operation of either set of doors 36, 36'.

As shown in FIGS. 4 and 5, the operating shaft 62 of each mechanism 60, 60' is operably connected to a set or pair of transversely disposed doors 36, 36' (FIG. 6) through a linkage system 70. In one form, and to facilitate simultaneous moving of each door 36, 36' in the respective set of doors on the hopper car 10 into their closed position in response to rotation of the operating shaft 62, linkage system 70 includes two substantially identical linkage assemblies 72 and 72'; with linkage assembly 72 being operably connected to one door in each set of transversely spaced doors and with linkage assembly 72' being operably connected to the transversely adjacent door in the same set of doors. Each linkage assembly includes multiple links 74 and 76 which are articulately connected to each other and to a respective set or pair of discharge doors 36, 36'.

In a preferred embodiment, the links 74, 76 of each linkage assembly 72, 74 operate to simultaneously push the doors into their closed position relative to the respective discharge openings. In one form of linkage system 70, and upon actuation of apparatus 50, the links 74, 76 of each linkage assembly 72, 72' pull the respective set of doors toward an open position.

Figure 6:
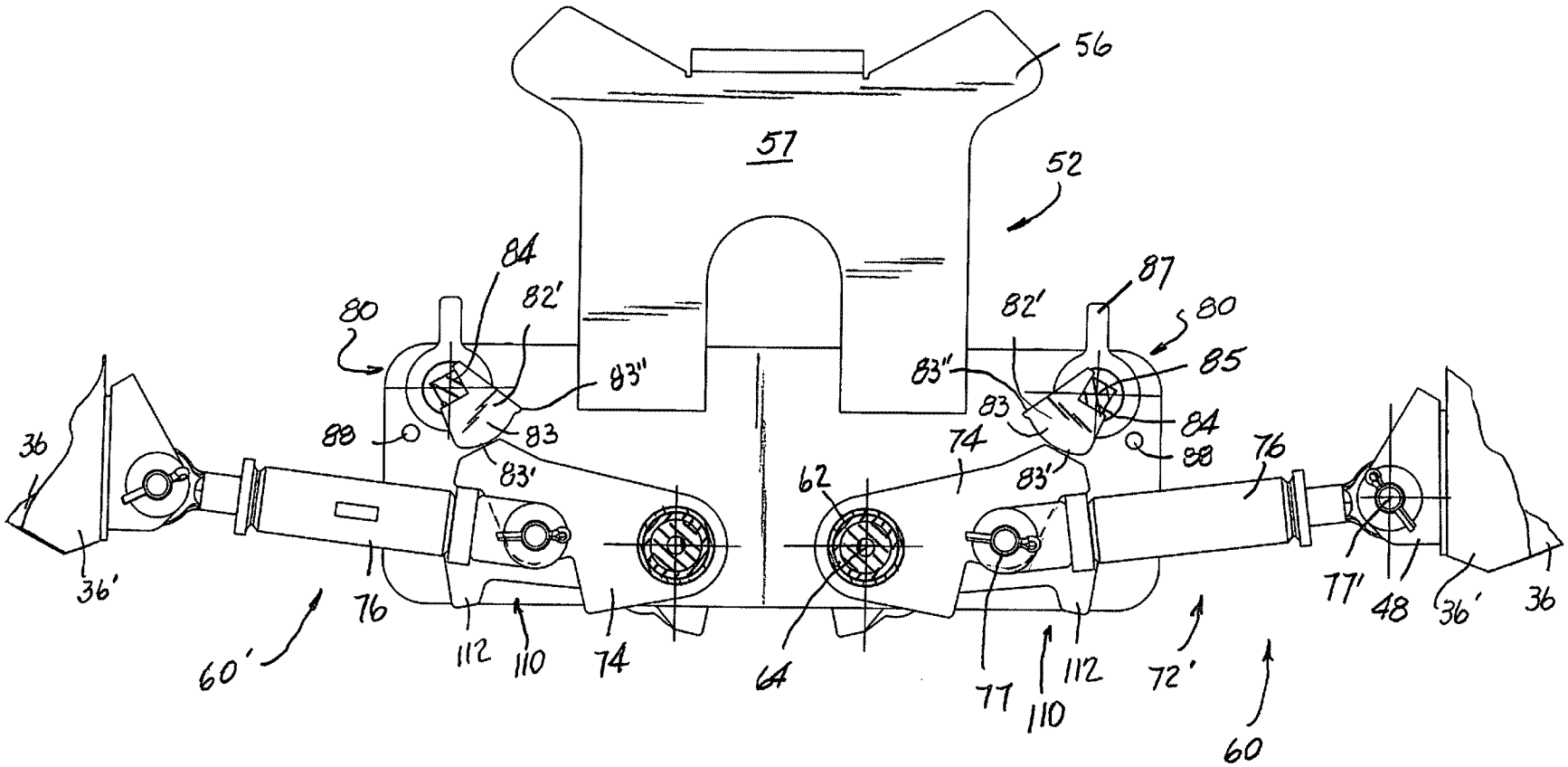
FIG. 6 is a sectional view taken along line 6-6 of FIG. 4 with the doors of the hopper car in a closed position.

In the embodiment illustrated in FIG. 6, link 74 of each linkage assembly is configured as an actuating link or lever which radially extends from the axis 64 and is nonrotatably secured or otherwise connected to operating shaft 62. As shown in FIG. 6, link 76 of each linkage assembly is preferably configured as a connecting link articulately joined toward one end to a location generally indicated in FIG. 6 by reference numeral 77 on lever 74 radially spaced from the axis 64 of operating shaft 62. Connecting link 76 of each linkage assembly 72, 72' is articulately connected toward an opposed end to the crossbar or connector 48 at a location generally indicated in FIG. 6 by reference numeral 77' whereby allowing the doors 36, 36' in each set of doors to be moved simultaneously relative to each other. In the illustrated embodiment of the invention disclosure, the location 77 whereat the links 74, 76 are articulately connected to each other is arranged in an overcenter relationship relative to a line passing from the location 77' whereat link 76 of each linkage assembly 72. 72' is articulately connected or joined to the to the crossbar or connector 48 to the axis 64 of rotation of operating shaft 62.

In a preferred embodiment, when the doors are in their closed position as shown in FIG. 6, the links 74 and 76 of each linkage assembly and their respective connections to the respective doors at location 77', to each other at location77, and relative to axis 64 of operating shaft 62 arearranged in an overcenter linkage design which serves as a primary lock for maintaining the respective doors in each set of doors in their closed position. As such, the connection established between lever 74 and link 76 of the respective linkage assembly is required to move overcenter when the doors 36, 36' move from their closed position toward an open position.

Returning to that embodiment of the invention disclosure illustrated by way of example FIGS. 3, 4 and 5, the operating shaft 62 of each mechanism 60, 60' of each apparatus 50 is preferably provided, toward each end, with an operating handle 78 configured to releasably accommodate a conventional opening bar (not shown) for manually rotating the operating shaft 62. Each operating handle 78 is nonrotatably secured or otherwise connected to the operating shaft 62 in axially spaced outward relation relative to the outer face 57' of the respective end plate 56, 56' and is disposed for ready accessibility from each side 14, 16 of the car 10 (FIG. 4). Moreover, each operating handle 78 rotates in a generally vertical plane extending generally parallel to the respective end plate 56, 56' and generally normal to the fixed axis 64 of the operating shaft 62. As will be appreciated, providing an operating handle toward each end of the operating shaft 62 allows each mechanism 60, 60' to be operated from either side 14, 16 of the railcar 10 (FIG. 4), thus, yielding control over the position of the doors 36, 36' and thereby selective control over the discharge of lading from the hopper 12 from either side 14, 16 of the railcar 10 (FIG. 2).

Preferably, each mechanism 60, 60' furthermore includes a secondary lock 80 mounted on the frame 52 for selectively maintaining the transversely spaced doors of each set or pair of doors in their closed position. In a preferred form, the secondary lock 80 includes a selectively operated stop 82 which is configured to coact with the respective linkage assembly. In a preferred form, the secondary lock 80 includes a substantially identical stop 82' disposed in laterally spaced relation from stop 82 such that each linkage assembly 72, 72' has a stop operably associated therewith. In the illustrated embodiment, and to facilitate operation of the secondary lock 80, the locks 82, 82' are preferably joined to each other by an elongated shaft 84 rotatably supported by the frame 52 such that the locks 82, 82' operate in unison relative to each other.

Since the stops 82, 82' are substantially identical, operation of only stop 82' will be discussed in detail. Each stop of lock 80 is rotatable about a fixed generally horizontal axis 85 defined by the elongated shaft 84. As shown, axis 85 is preferably disposed above and in generally parallel relationship relative to axis 64 about which operating shaft 62 rotates. Arranging each stop for rotation above axis 64 yields several advantages. First, arranging the stop for rotation above axis 64 beneficially allows gravity to facilitate operation of the stop 82. Second, arranging the stop for rotation above axis 64 beneficially yields enhanced visual access to the disposition of the stop 82 relative to each respective linkage assembly.

In one embodiment, shaft 84 is of sufficient length to extend across the car 10 (FIGS. 4 and 5) such that the ends of shaft 84 are readily accessible to effect selective operation of the secondary lock 80 from either side 14, 16 (FIG. 4) of the car 10. The shaft 84 of each secondary lock 80 is preferably provided, toward each end, with an operating handle 86 configured to releasably accommodate a conventional tool (not shown) for manually rotating shaft 84 about axis 85 to release the secondary lock 80, when desired.

As shown in FIGS. 4 and 5, each operating handle 86 is nonrotatably secured or otherwise connected to shaft 84 in axially spaced outward relation relative to the outer face 57' of the respective end plate 56, 56' and, as mentioned, is preferably disposed for ready accessibility from each side 14, 16 of the car 10 (FIG. 4). Moreover, each operating handle 86 rotates in a generally vertical plane extending generally parallel to the respective end plate 56, 56'. As will be appreciated, providing an operating handle toward each end of shaft 84 allows the secondary lock 80 to be operated from either side 14, 16 of the railcar 10 (FIG. 4), thus, yielding control over the position of the doors 36, 36' and thereby selective control over the discharge of lading from the hopper 12.

The stop of the secondary lock 80 of each mechanism 60, 60' is rotatable between a first condition (FIG. 6), wherein the stop operably engages with at least one link 74, 76 of the linkage assembly 72 so as to maintain the links 74 and 76 in an overcenter relationship relative to each other, and a second position (FIG. 7), wherein each the stop of the secondary lock is located out of the path of the respective links 74 and 76 so as to permit the respective door to be moved toward an open position. As shown by way of example in FIG. 6, each stop preferably includes a locking member or lever 83 which radially extends from and is operably connected to the shaft 84 such that the locking member or lever 83 rotates with shaft 84.

As shown in FIG. 6, toward its outer edge, the locking member 83 on the stop of each secondary lock preferably includes a cam surface 83' which is arranged in overlying relation and preferably abutting relation relative to and with at least one link 74, 76 of the respective linkage assembly so as to maintain the links 74 and 76 of that respective linkage assembly in an overcenter relationship relative to each other. When it is desired to open the doors, shaft 84 is simply rotated in an appropriate direction to remove the cam surface 83' of the locking member or lever 83 out of the path of the respective links 74 and 76 and from it's overlying and preferably abutting relation relative to and with at least one link 74, 76 of the respective linkage assembly whereby allowing each respective linkage assembly 72, 72' to collapse whereby allowing the doors to move toward their open position.

As shown in FIG. 6, the locking member or lever 83 of each stop is furthermore preferably provided with a stop 83" for limiting rotational movement of the locking member or lever 83 relative to the first or locked condition and relative to at least one link 74, 76 of the respective linkage assembly 72. 72'. Stop 83" can take any of ma myriad of designs for effecting the desired ends. In the illustrated embodiment, stop 83" includes a radial projection designed to limit the rotational disposition of lever 83 relative to its overlying and preferably abutting relation relative to and with at least one link 74, 76 of the respective linkage assembly.

The secondary lock 80 of each mechanism 60, 60' is furthermore preferably designed to limit rotational movement of either stop 82, 82' or both relative to their second or unlocked condition. As illustrated by way of example in FIG. 6, and preferably disposed toward an inner face 57 of at least one end plate 56, 56' of frame 52, an ear 87 radially projects away from the axis 85 about which each stop rotates to limit its rotation about axis 84. Notably, ear 87 moves in a predetermined path of travel between the locked and unlocked conditions of each stop.

Figure 7:
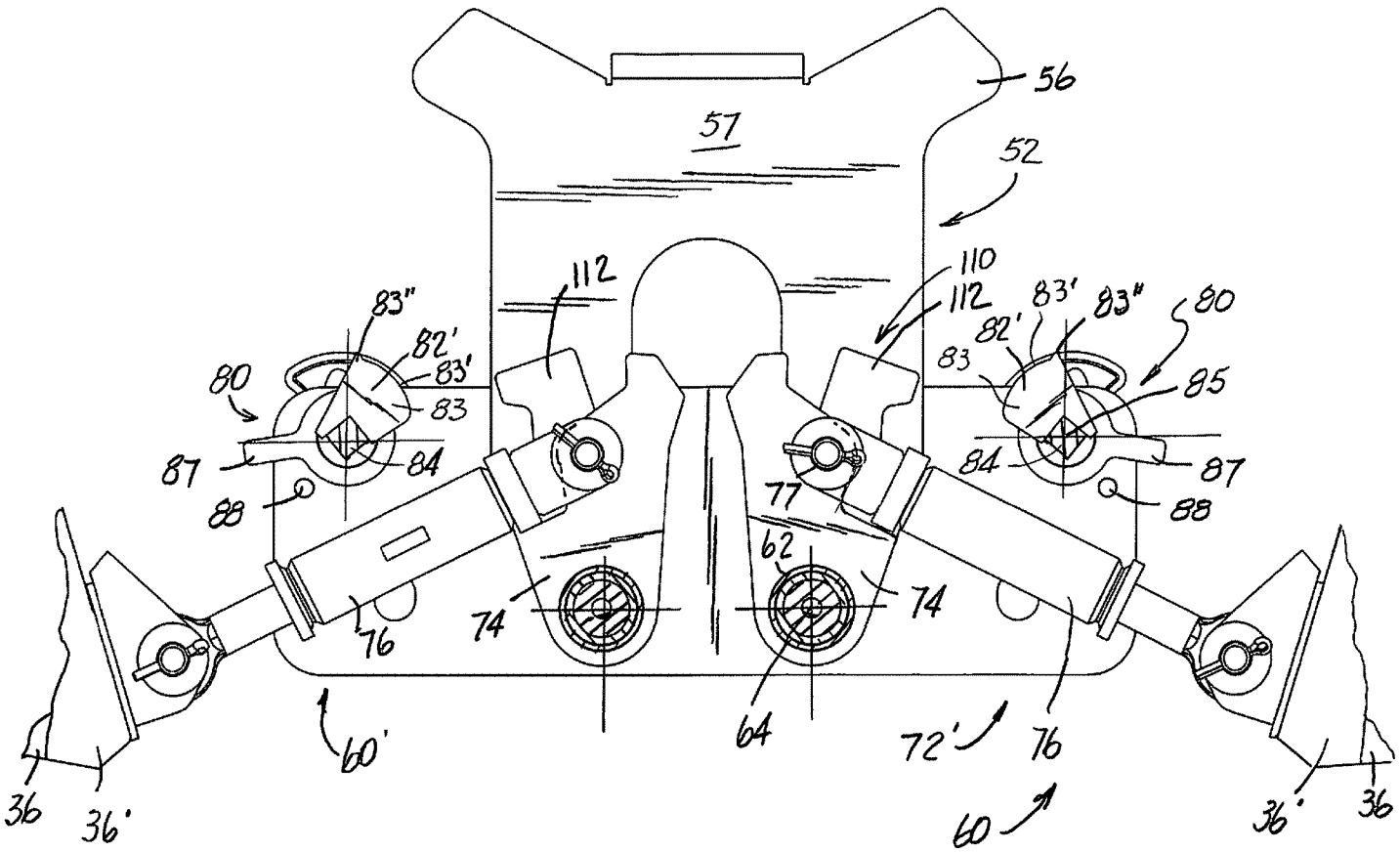
FIG. 7 is a sectional view similar to FIG. 6 but showing the doors of the hopper car in an open position.

As shown in FIGS. 5, 6 and 7, a stop pin 88, carried by the respective end plate 56. 56' of frame 52, projects inwardly toward a center of each apparatus and toward a respective center support 54, 54' such that at least a lengthwise portion of the stop pin 88 lies in the predetermined path of travel of the ear 87. Suffice it to say, when the ear 87 and stop pin 88 operably cooperate and combine with each other, the stop 82 has been moved a sufficient distance to allow the links 74, 76 of the respective linkage assembly to be move whereby allowing the door operably connected thereto to move toward an open position.

In the illustrated embodiment, the ear 87 is arranged in operable combination with stop 82 and a duplicate ear 87' is arranged in laterally spaced relation from and operable combination with stop 82'. In the illustrated embodiment, each ear 87, 87' is operably associated with and moves with the shaft 84 such that rotation of either stop 82, 82' preferably moves both ears 87, 87' with shaft 84.

As shown in FIGS. 8 and 9, the end of link 76 of each linkage assembly articulately joined to link 74 is preferably configured with a generally U-shaped connector or clevis 92 including a pair of generally parallel arms 94 and 96 which slidably embrace lever 74 therebetween. and which are joined by a bight portion 98. A suitable connector 100, such as a suitable pin or bolt, passes endwise through the arms 94, 96 of connector 92 and through that portion of the lever 74 embraced therebetween to operably and articulately connect links 74 and 76 to each other at a distance radially spaced from axis 64 of rotation of lever 74.

In a preferred embodiment, the linkage assembly 72, 72' of each mechanism 60, 60' includes a stop, generally identified in FIG. 8 by reference numeral 90, for limiting movements of the hinged doors of each set of doors toward their closed position. As shown by way of example in FIGS. 8 and 10, and toward that end of the lever 74 of each linkage assembly connected to the respective link 76, lever 74 has a peripheral face 102 significant portions of which are identified as 104*a* and, 104*b*. When apparatus 50 is operated to move the respective set of doors 36, 36' into their closed position, the respective operating shaft 62 is rotated, as shown in FIG. 8, in a clockwise direction with lever 74 of each linkage assembly 72, 72' moving therewith in a clockwise direction. As will be appreciated from FIG. 8, rotation of the operating shaft 62 in a clockwise direction to close the respective set of doors 36, 36' continues until portion 104*a* of lever 74 engages portion 98 of clevis 92 on link 76. As such, further rotation of the lever or link 74 and thus, further rotation of the operating shaft 62 is halted or prevented by the abutting relationship between lever 74 and the clevis 92 on link 76.

In a preferred embodiment of this invention disclosure, portion 104*a* of lever 74 is specifically configured such that when abutment occurs between portion 104*a* on lever 74 and portion 98 on clevis 92, the links 74 and 76 of each linkage assembly 72, 72' have assumed an overcenter relation relative to each other and relative to axis 64 of the operating shaft 62 and to the location 77 (FIG. 6) whereat the link 76 is articulately joined to the crossbar or connector 48 whereby establishing a primary lock for the respective linkage assembly 72, 72' of linkage system 70 when the doors 36, 36 of each set of doors are in their closed position.

Figure 10:
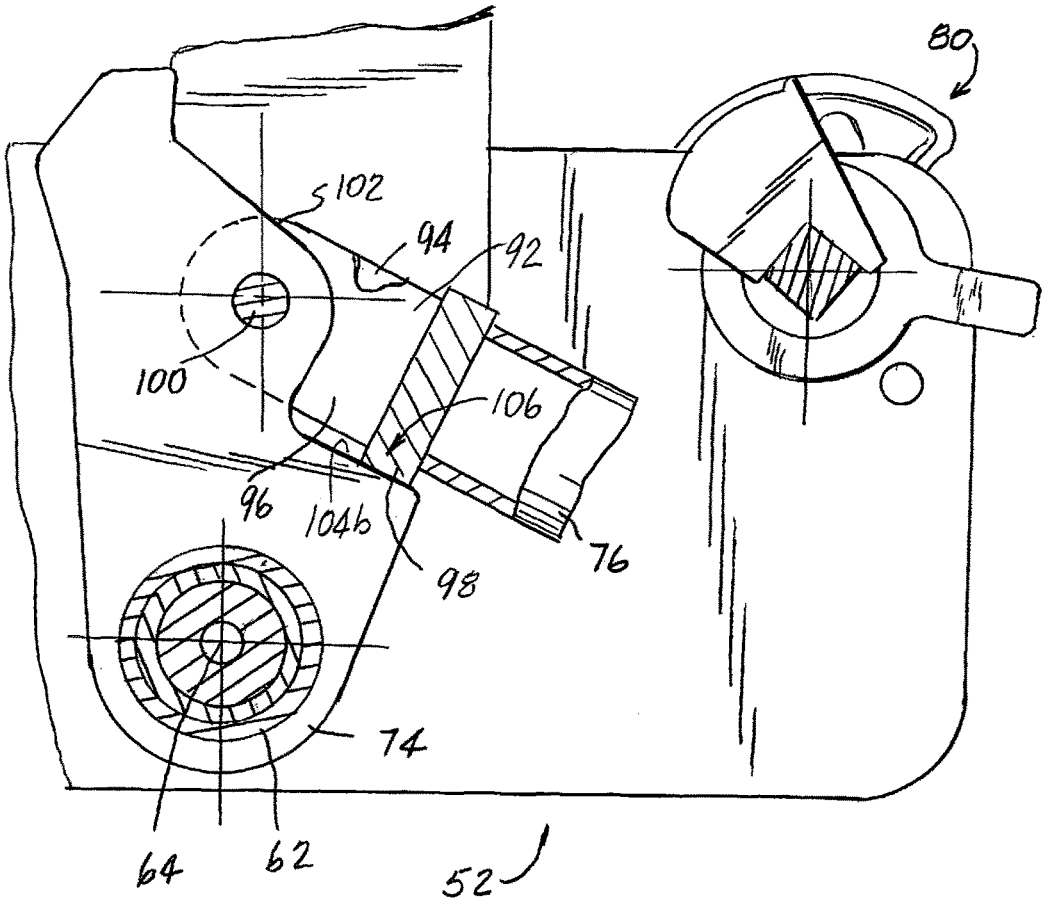

In a preferred embodiment, the linkage assembly 72, 72' of each mechanism 60, 60' further includes a stop, generally identified in FIG. 10 by reference numeral 106, for limiting movements of the hinged doors 36, 36' of each set of doors toward their open position. As linkage system 70 is operated to move the doors from their closed position, and following conditioning of the secondary lock 80 to allow the operating shaft 62 to be rotated along with lever 74 in a direction to open the doors 36, 36', the links 74, 76 of each linkage assembly 72, 72' are preferably configured to act in combination relative to each other to limit their range of movement relative to each other and thereby limit the range of movement of the doors 36, 36' toward an open position.

When apparatus 50 is operated to move the respective set of doors into their open position, and following conditioning of stop 80, the respective operating shaft 62 is rotated, as shown in FIG. 10, in a counterclockwise direction with lever 74 of each linkage assembly 72, 72' moving therewith in a counterclockwise direction. As will be appreciated from FIG. 10, rotation of the operating shaft 62 in a counterclockwise direction to open each set of doors continues until portion 104*c* of lever 74 engages with the bight portion 98 of the clevis 92 on link 76. As such, further counterclockwise rotation of the lever 74 and, thus, the operating shaft 62 is halted or stopped by the abutting relationship of portion 104*b* on lever 74 against the clevis 92 on link 76. Preferably, the portion 104*b* on lever 74 is specifically configured such that when abutment occurs between portion 104*c* on lever 74 and clevis 92 on link 76, the doors 36, 36' (FIG. 3) are in a full open position.

In a preferred form, each mechanism 60, 60' of apparatus 50 furthermore includes a door release mechanism, generally indicated by reference numeral 110 in FIGS. 4, 5, 11 and 12. In one form, the door release mechanism 110 for each mechanism 60, 60' is substantially identical in construction and operation and, thus, only one mechanism will be described in detail. Preferably, each release mechanism 110 is manually operated and is mounted on the frame 52 for facilitating movement of each set of doors from their closed position toward an open position.

Figure 11:
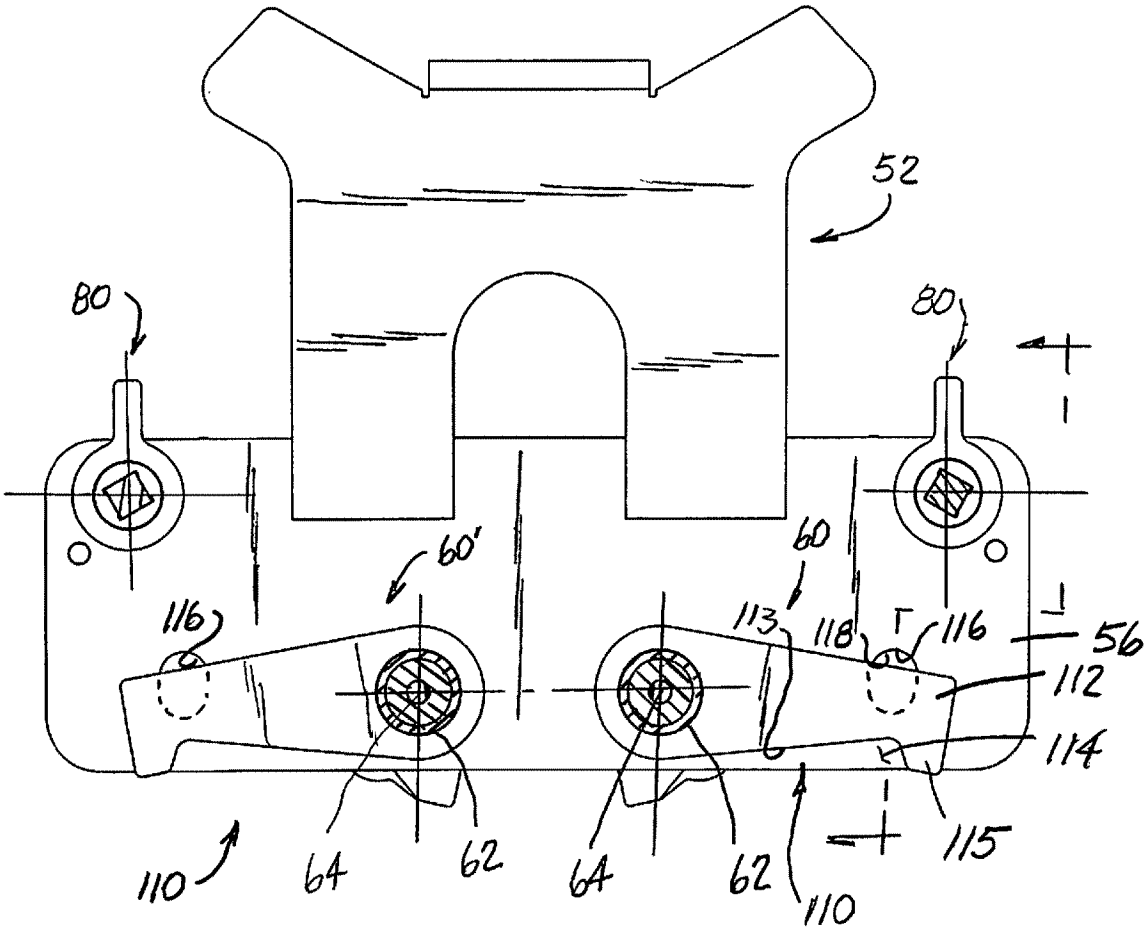
FIG. 11 is a sectional view taken along line 11-11 of FIG. 4.
Figure 12:
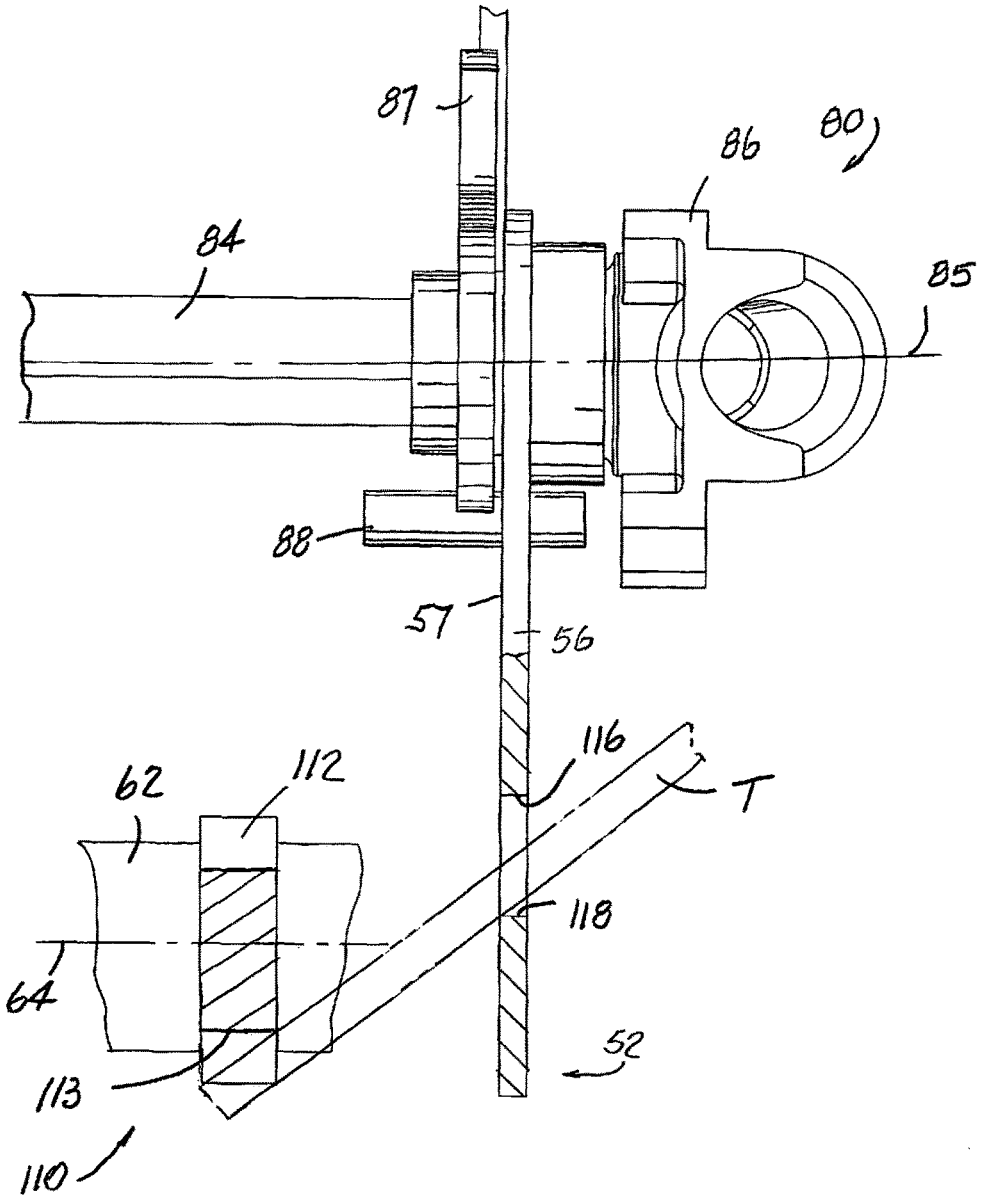
FIG. 12 is an enlarged sectional view taken along line 12-12 of FIG. 11.

As shown in FIGS. 5, 11 and 12, the release mechanism 110 includes a release lever 112 mounted on and for rotation with the operating shaft 62 about axis 64. In the embodiment illustrated in FIG. 12, release lever 112 of mechanism 110 is mounted on the frame 52 adjacent to an inner face 57 of the end plate 56. In the embodiment shown in FIG. 5, the release lever 112 is operably associated with the linkage assembly 72 of mechanism 60 such that rotation of the release lever 112 moves at least one of the links 74, 76 of each linkage assembly from being overcenter relative to the other link of the linkage system thereby allowing the respective doors 36, 36' to be forcibly moved toward the open position under the influence of the columnar load being placed on the doors by lading within the hopper 12 (FIG. 1).

In the embodiment illustrated by way of example in FIG. 11, a distal end of the release lever 112 is preferably provided with a hook-like configuration. That is, in one form, an underside 113 of the distal end of lever 112 defines a recess 114 and a projection 115 which releasably captures or releasably holds a tool T (FIG. 12) in operable association with the lever 112.

As shown in FIGS. 11 and 12, the end plate 56 of frame 52 defines a throughbore or opening 116 elevationally arranged or disposed relative to the underside or lower surface 113 on lever 112 when the doors 36, 36' of each set of doors are in their closed position. In the illustrated embodiment, the throughbore or opening 116 has a closed marginal edge 118 and is sized to allow tool T to extend endwise therethrough and into operable association with the underside 113 of the release lever 112. As such, and when a set of doors are to be opened, and after conditioning the secondary lock 80 to permit the doors 36, 36' to be opened, tool T is endwise inserted through the opening 116 with the marginal edge 118 of the opening 116 acting as a fulcrum to permit an upward force to be directed to the release lever 112 whereby moving the links 74, 76 of linkage 72 overcenter of each other. Thereafter, the columnar load of the commodity in the hopper 12 (FIG. 1) acting on the doors 36, 36' will forcibly moves the doors 36, 36' toward their open position whereby permitting the gravitational discharge of material from hopper 12 (FIG. 1).

In one form, the release mechanism 110 includes a second release lever 112' mounted on the frame 52 for rotation about a fixed axis. In a preferred embodiment, the release lever 112' is substantially identical to and arranged in laterally spaced relation from release lever 112. Lever 112' is operably associated with the linkage assembly 72 of mechanism 60 such that rotation of the release lever 112' moves at least one of the links 74, 76 of linkage assembly 72 from being overcenter relative to the other link of the linkage system thereby allowing the respective doors 36, 36' to be forcibly moved toward the open position under the influence of the columnar load being placed on the doors by lading within the hopper 12 (FIG. 1). In the illustrated embodiment, the release lever 112' of mechanism 110 associated with linkage assembly 72 is arranged adjacent to the inner face 57 of end plate 56 on frame 52 such that the release mechanism 110 can be manually operated from either side of the railcar 10 (FIG.1) in the manner described above.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A mechanism for operating a pair of hinged doors on a railroad hopper car between closed and open positions, with said railroad hopper car having a centersill defining a longitudinal axis, a hopper operably supported on the centersill, with said pair of hinged doors being arranged in operable combination with adjoining hopper openings defined by said hopper and disposed to opposed lateral sides of the longitudinal axis of the hopper car, with said door operating mechanism comprising:

an elongated operating shaft rotatable about a fixed axis and adapted to extend transverse to the longitudinal axis of said hopper car, with said operating shaft being configured to extend across said railcar such that opposed ends of said shaft are each accessible from a side of the hopper car to effect selective operation of said hinged doors;

a linkage system for operably connecting said operating shaft to the hinged doors on said railroad hopper car to simultaneously move said doors into their closed positions in response to rotation of said operating shaft, with said linkage system including an actuating link operably connected to and rotatable with said operating shaft and a connecting link for operably connecting said actuating link to said doors, with said links of said linkage system being arranged in an overcenter relationship relative to each other when said doors are in the closed position whereby locking said doors closed; and a selectively operated stop rotatable about a fixed axis disposed above the fixed axis of said operating shaft assembly, with said stop being rotatable between a first condition, wherein said stop engages with at least one link of said linkage assembly to prevent rotation of said operating shaft while maintaining the links of said linkage system in an overcenter relationship relative to each other, and a second condition, wherein said doors are permitted to move to the open position.

2. The mechanism for operating the pair of hinged doors on said railroad hopper car according to claim 1 further including a transversely elongated connector for joining said doors to each other.

3. The mechanism for operating the pair of hinged doors on said railroad hopper car according to claim 1, wherein said actuating link of said linkage system is one of duplicate actuating links operably connected to and rotatable with said operating shaft, and wherein said connecting link of said linkage system is one of duplicate connecting links for operably connecting a respective actuating link to said doors.

4. The mechanism for operating the pair of hinged doors on said railroad hopper car according to claim 1, wherein said linkage system includes a stop for limiting movements of said hinged doors toward their open position.

5. The mechanism for operating the pair of hinged doors on said railroad hopper car according to claim 1, wherein said linkage system includes a stop for limiting movements of said hinged doors toward their closed position.

6. The mechanism for operating the pair of hinged doors on said railroad hopper car according to claim 1, wherein said selectively operated stop has limited rotation about its fixed axis.

7. The mechanism for operating the pair of hinged doors on said railroad hopper car according to claim 1, wherein said operating shaft, said linkage system and said selectively operated stop are all mounted on a frame mountable to said railroad hopper car.

8. A mechanism for operating a pair of hinged doors on a railroad hopper car, with said railroad hopper car having a centersill defining a longitudinal axis, a pair of drop-bottom outlets for discharging lading from a hopper operably carried on said centersill, with said outlets being disposed on opposed lateral sides of the longitudinal axis of said car, and with each outlet having one of said hinged doors arranged in operable combination therewith for movement between a closed position and an open position, and with a length and width of each outlet being sufficient to inhibit lading from bridging over the outlet thereby facilitating discharge of lading from said hopper, with said door operating mechanism comprising:

a frame mountable to said railroad hopper car;

an elongated operating shaft mounted on said frame for rotation about a fixed axis and adapted to extend transverse to the longitudinal axis of said hopper car, with said operating shaft being configured to extend across said railroad hopper car such that opposed ends of said shaft are each accessible from a side of the hopper car to effect selective operation of said pair of hinged doors;

a linkage system for operably connecting said operating shaft to the hinged doors on said railroad hopper car to simultaneously move said doors into their closed positions in response to rotation of said operating shaft, with said linkage system including an actuating link operably connected to and rotatable with said operating shaft and a connecting link for operably connecting said actuating link to said doors, with said links of said linkage system being arranged in an overcenter relationship relative to each other when said doors are in the closed position whereby locking said doors closed; and a door release mechanism including a release lever mounted on said frame for rotation about a fixed axis, with said lever being operably associated with said linkage system such that rotation of said lever moves at least one of said links from being overcenter relative to the other link of said linkage system thereby allowing the doors to be forcibly moved toward the open position under the influence of the columnar load being placed on said doors by lading in said hopper.

9. The mechanism for operating the pair of hinged doors on said railroad hopper car according to claim 8, further including a transversely elongated connector for joining said hinged doors to each other.

10. The mechanism for operating the pair of hinged doors on said railroad hopper car according to claim 8, wherein said actuating link of said linkage system is one of duplicate actuating links operably connected to and rotatable with said operating shaft, and wherein said connecting link of said linkage system is one of duplicate connecting links for operably connecting a respective actuating link to said doors.

11. The mechanism for operating the pair of hinged doors on said railroad hopper car according to claim 8, wherein said linkage system includes a stop for limiting movements of said doors toward their open position.

12. The mechanism for operating the pair of hinged doors on said railroad hopper car according to claim 8, wherein said linkage system includes a stop for limiting movement of said doors toward their closed position.

13. The mechanism for operating the pair of hinged doors on said railroad hopper car according to claim 8, further including a selectively operated stop rotatable about a fixed axis disposed above the fixed axis of said operating shaft assembly, with said stop being rotatable between a first condition, wherein said stop engages with at least one link of said linkage assembly whereby maintaining the links of said linkage system in an overcenter relationship relative to each other, and a second condition, wherein said doors are permitted to move to the open position.

14. The mechanism for operating the pair of hinged doors on said railroad hopper car according to claim 13, wherein said selectively operated stop has limited rotation about its fixed axis.

15. A mechanism for operating a pair of hinged doors on a railroad hopper car between closed and open positions, with said railroad hopper car having a centersill defining a longitudinal axis, a hopper operably supported on the centersill, with said hinged doors being arranged in operable combination with adjoining hopper openings defined by said hopper and disposed to opposed lateral sides of the longitudinal axis of the hopper car, with said door operating mechanism comprising:

an elongated operating shaft rotatable about a fixed axis and adapted to extend transverse to the longitudinal axis of said hopper car, with said operating shaft being configured to extend across said railcar such that opposed ends of said shaft are each accessible from a side of the hopper car to effect selective operation of said doors;

a linkage system for operably connecting said operating shaft to the hinged doors on said railroad hopper car to simultaneously move said doors into their closed positions in response to rotation of said operating shaft in first direction, with said linkage system including a crank arm operably connected to and rotatable with said operating shaft and a link for operably connecting said crank arm to said doors, with said crank arm and said connecting link of said linkage system being arranged in an overcenter relationship relative to each other when said doors are in the closed position so as to provide a releasable lock against the doors moving toward the open position;

a selectively operated stop rotatable about a fixed axis disposed above the fixed axis of said operating shaft assembly, with said stop being rotatable between a first condition, wherein said stop engages with at least one of said crank arm and said connecting link of said linkage system whereby preventing rotation of said operating shaft while maintaining the crank arm and said connecting link of said linkage system in an overcenter relationship relative to each other, and a second condition, wherein said doors are permitted to move to the open position; and a door release mechanism rotatable about a fixed axis for releasing said lock by moving at least one of said crank arm and said connecting link from being overcenter relative to the other one of said crank arm and said connecting link thereby allowing the doors to be forcibly moved toward their open position under the influence of the columnar load being placed on said doors by the lading in said hopper.

16. The mechanism for operating the pair of hinged doors on said railroad hopper car according to claim 15, further including a transversely elongated connector for joining said doors to each other.

17. The mechanism for operating the pair of hinged doors on said railroad hopper car according to claim 15, wherein said crank arm of said linkage system is one of duplicate crank arms operably connected to and rotatable with said operating shaft, and wherein said connecting link of said linkage system is one of duplicate connecting links for operably connecting a respective actuating link to said doors.

18. The mechanism for operating the pair of hinged doors on said railroad hopper car according to claim 15, wherein said linkage system includes a stop for limiting movements of said doors toward their open position.

19. The mechanism for operating the pair of hinged doors on said railroad hopper car according to claim 15, wherein said linkage system includes a stop for limiting movements of said doors toward their closed position.

20. The mechanism for operating the pair of hinged doors on said railroad hopper car according to claim 15, wherein said operating shaft, said linkage system and said selectively operated stop are all mounted on a frame mountable to said railroad hopper car.

21. The mechanism for operating the pair of hinged doors on said railroad hopper car according to claim 15, wherein said selectively operated stop is configured to limit rotation of said stop about its fixed axis.

22. A mechanism for operating a pair of hinged doors on a railroad hopper car between closed and open positions, with said railroad hopper car having a centersill defining a longitudinal axis, a hopper operably supported on the centersill, with said hinged doors being arranged in operable combination with adjoining hopper openings defined by said hopper and disposed to opposed lateral sides of the longitudinal axis of the hopper car, with said door operating mechanism comprising:

a linkage system including an actuating link having a first fixed fulcrum and a connecting link for operably connecting said actuating link to said hinged doors and for simultaneously pushing said doors into their closed positions in response to rotation of said actuating link about the first fixed fulcrum, with said links of said linkage system being operably connected in an overcenter relationship relative to each other when said doors are in the closed position whereby locking said doors closed; and a selectively operated stop rotatable about a second fixed fulcrum disposed above the first fixed fulcrum of said operating shaft assembly, with said stop being rotatable between a first condition, wherein said stop engages with at least one link of said linkage assembly whereby maintaining the links of said linkage system in an overcenter relationship relative to each other, and a second condition, wherein said doors are permitted to move to the open position.

23. The mechanism for operating the pair of hinged doors on said railroad hopper car according to claim 22, further including a transversely elongated connector for joining said doors to each other.

24. The mechanism for operating the pair of hinged doors on said railroad hopper car according to claim 22, wherein said actuating link of said linkage system is one of duplicate actuating links rotatable about said first fixed fulcrum, and wherein said connecting link of said linkage system is one of duplicate connecting links for operably connecting a respective actuating link to said doors.

25. The mechanism for operating the pair of hinged doors on said railroad hopper car according to claim 22, wherein said linkage system includes a stop for limiting movements of said doors toward their open position.

26. The mechanism for operating the pair of hinged doors on said railroad hopper car according to claim 22, wherein said linkage system includes a stop for limiting movements of said doors toward their closed position.

27. The mechanism for operating the pair of hinged doors on said railroad hopper car according to claim 22, wherein said linkage system and said selectively operated stop are mounted on a frame mountable to said railroad hopper car.

28. The mechanism for operating the pair of hinged doors on said railroad hopper car according to claim 22, wherein said selectively operated stop is configured to limit rotation of said stop about its fixed axis.

29. The mechanism for operating the pair of hinged doors on said railroad hopper car according to claim 22, a manually operated door release mechanism for releasing said lock by moving at least one of said actuating link and said connecting link of said linkage system from being overcenter relative to the other one of said actuating link and said connecting link thereby allowing the doors to be forcibly moved toward the open position under the influence of the columnar load being placed on said doors by the lading in said hopper.

30. A mechanism for operating a hinged door on a railroad hopper car between closed and open positions, with said railroad hopper car having a hopper, with said hinged door being arranged in operable combination with an opening defined by said hopper, with said door operating mechanism comprising:

an elongated operating shaft rotatable about a fixed axis;

a linkage system for operably connecting said operating shaft to the hinged door on said railroad hopper car to move said door into the closed position in response to rotation of said operating shaft, with said linkage system including an actuating link operably connected to and rotatable with said operating shaft and a connecting link for operably connecting said actuating link to said door, with said links of said linkage system being arranged in an overcenter relationship relative to each other when said door is in the closed position whereby locking said door closed; and a selectively operated stop rotatable about a fixed axis disposed above the fixed axis of said operating shaft assembly, with said stop being rotatable between a first condition, wherein said stop engages with at least one link of said linkage assembly to prevent rotation of said operating shaft while maintaining the links of said linkage system in an overcenter relationship relative to each other, and a second condition, wherein said door is permitted to move to the open position.

31. The mechanism for operating the hinged door on said railroad hopper car according to claim 30, wherein said linkage system includes a stop for limiting movements of said hinged door toward the open position.

32. The mechanism for operating the hinged door on said railroad hopper car according to claim 30, wherein said linkage system includes a stop for limiting movements of said hinged door toward the closed position.

33. The mechanism for operating the hinged door on said railroad hopper car according to claim 30, further including a door release mechanism including a release lever operably associated with said linkage system such that rotation of said release lever moves at least one of said links from being overcenter relative to the other link of said linkage system thereby allowing the door to be forcibly moved toward the open position under the influence of the columnar load being placed on said door by lading in said hopper.

34. The mechanism for operating the hinged door on said railroad hopper car according to claim 30, wherein said operating shaft, said linkage system and said selectively operated stop are all mounted on a frame mountable to said railroad hopper car.

35. A mechanism for operating a hinged door on a railroad hopper car between closed and open positions, with said railroad hopper car having a hopper, with said hinged door being arranged in operable combination with an opening defined by said hopper, with said door operating mechanism comprising:

an elongated operating shaft rotatable about a fixed axis;

a linkage system for operably connecting said operating shaft to the hinged door on said railroad hopper car to move said door into the closed position in response to rotation of said operating shaft, with said linkage system including an actuating link operably connected to and rotatable with said operating shaft and a connecting link for operably connecting said actuating link to said door, with said links of said linkage system being arranged in an overcenter relationship relative to each other when said door is in the closed position whereby locking said door closed; and a door release mechanism including a release lever operably associated with said linkage system such that rotation of said release lever moves at least one of said links from being overcenter relative to the other link of said linkage system thereby allowing the door to be forcibly moved toward the open position under the influence of the columnar load being placed on said door by lading in said hopper.

* * * * *